United States Patent [19]

Kozuka et al.

[11] Patent Number: 4,477,173

[45] Date of Patent: Oct. 16, 1984

[54] TONER REPLENISHING DEVICE FOR AN ELECTROSTATIC COPYING APPARATUS

[75] Inventors: Nobuhiko Kozuka; Shigeo Koyama; Masami Kai; Ichiro Takahashi; Hiromi Sakata; Atsushi Kano, all of Osaka, Japan

[73] Assignee: Mita Industrial Company Limited, Osaka, Japan

[21] Appl. No.: 393,871

[22] Filed: Jun. 30, 1982

[30] Foreign Application Priority Data

Jun. 30, 1981 [JP] Japan ..... 56-102944

[51] Int. Cl.[3] ..... G03G 15/00

[52] U.S. Cl. ..... 355/3 DD; 222/DIG. 1; 222/626

[58] Field of Search ..... 355/3 DD; 222/DIG. 1, 222/626, 622; 366/186, 195, 271, 607

[56] References Cited

U.S. PATENT DOCUMENTS 3,610,474 10/1971 Usher et al. ..... 222/178

4,080,054 3/1978 Watanabe .

*Primary Examiner*—John Gonzales

*Assistant Examiner*—David Warren

*Attorney, Agent, or Firm*—Wenderoth, Lind & Ponack

[57] ABSTRACT

A toner replenishing device for replenishing toner to a developing device in an electrostatic copying apparatus includes a storing box extending in approximately a horizontal direction, a supply roller provided at a supply port at an end of the storing box, pairs of wheels respectively provided at opposite ends of the storing box, a pair of endless stretched members passed around the wheels, a stirring and supply rod provided between the endless stretched members, and a device for driving the wheels so as to move the lower portion of the endless stretched members toward the supply roller.

2 Claims, 5 Drawing Figures

TONER REPLENISHING DEVICE FOR AN ELECTROSTATIC COPYING APPARATUS

BACKGROUND OF THE INVENTION

1. Field of the Invention

The present invention relates to a toner replenishing device for replenishing toner to a developing device in an electrostatic copying apparatus.

2. Description of the Prior Art

There has been well known an arrangement for supplying a proper amount of toner to a developing device through rotation of a sponge-like roller for a proper period of time. However, in order to employ such arrangement, it is necessary to maintain a state in which the toner contacts the peripheral surface of the sponge-like roller at all times, while it is also necessary to replenish a large amount of toner for effecting copying of a large number of copy paper sheets. Therefore, it has been consequently required that a comparatively great bulk of toner be stored in an accommodating or storing box. Accordingly, no toner replenishing device employing a storing box with a shallow bottom has been put into practical application up to the present, and even using a storing box having a deep bottom, it has been impossible to stably supply the toner to the developing device before the toner is almost completely consumed.

Therefore, a primary object of the present invention is to provide a toner replenishing device which is arranged to be capable of stably replenishing the toner through substantial elimination of the drawbacks of conventional arrangements of this kind.

SUMMARY OF THE INVENTION

To accomplish the foregoing object, there is provided a toner replenishing device which comprises a supply roller adjacent a supply port at an end of a storing box extending in an approximately horizontal direction, pairs of winding wheels at a position adjacent to the supply roller and at an opposite end of the storing box, and a stirring and supply rod provided between a pair of endless stretched members passed around the wheels close to opposite side walls of the storing box. The lower portions of the endless stretched members are driven toward the supply roller.

According to this invention, since the toner is gathered in the vicinity of the peripheral surface of the supply roller until the toner is almost completely used up, stable supply of the toner may be achieved.

In accordance with a preferred embodiment, the wheels are sprockets or pulleys, and the endless stretched members are chains, wires or belts. The width of the storing box may be selected to correspond to the entire length of a developing roller, and the supply port may be formed between the opposite side walls of the storing box.

BRIEF DESCRIPTION OF THE DRAWINGS

This invention will now be described in more detail by reference to the accompanying drawings, wherein.

DETAILED DESCRIPTION OF THE PREFERRED EMBODIMENT

Figure 1:
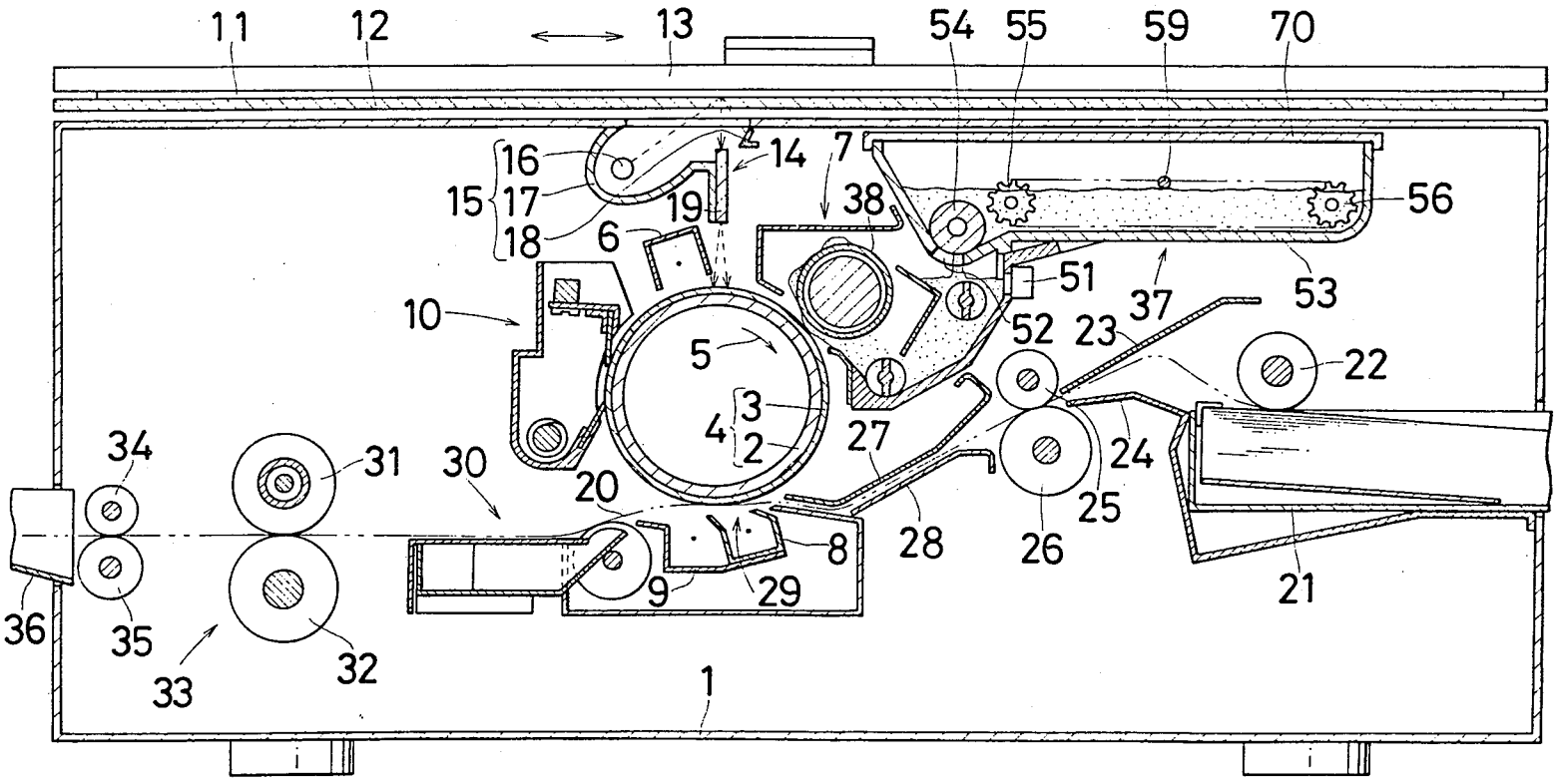
FIG. 1 is a schematic vertical sectional view of a transfer type electrostatic copying apparatus, as observed from the front side, according to a preferred embodiment of the invention.

Referring now to the drawings, there is shown in FIG. 1 a schematic vertical sectional view of a transfer type electrostatic copying apparatus, as viewed from the front side, according to a preferred embodiment of the present invention. At approximately a central portion of an apparatus housing 1, there is rotatably provided a photosensitive or photoreceptor drum 4 prepared by applying a photosensitive layer 3 onto an outer peripheral surface of a drum 2. Around the photoreceptor drum 4, there are sequentially disposed, along a direction of rotation of drum 4 indicated by an arrow 5, various processing devices such as a corona charger 6 for uniformly charging the photosensitive layer 3, a developing device 7 for developing an electrostatic latent image formed on the photosensitive layer 3 into a visible toner image, a transfer corona charger 8 for transferring the toner image from the photosensitive layer 3 onto a copy paper sheet, a separation corona charger 9 for separating the copy paper sheet from the photosensitive layer 3, and a cleaning device 10 for cleaning the toner remaining on the photosensitive layer 3 after the transfer process.

Meanwhile, at an upper portion of the apparatus housing 1, there is movably disposed an original document support table 12 for reciprocation in the directions as indicated by the double-headed arrow, with an original document 11 horizontally placed thereon. The original document 11 on support table 12 is held in position by an original document presser member 13 provided on support table 12. Above the photoreceptor drum 4, an exposure device 14 is provided for projecting a light image of the original document 11 onto the photosensitive layer 3 in a position between the corona charger 6 and the developing device 7 as indicated by dotted line arrows. In the exposure device 14, a light projection means 15 for projecting light onto the original document 11 through the original document support table 12 further includes an exposure lamp 16, a reflection plate 17 and an auxiliary reflecting plate 18. The light directed from the above light projection means 15 onto the original document 11 on the original document support table 12 is projected onto the photosensitive layer 3 through a single focal point lens 19 to form the image of the original document 11 in the form of the electrostatic latent image on photosensitive layer 3.

On the other hand, copy paper sheets accommodated in a stack on a copy paper feeding cassette 21 provided at a lower right hand side of the apparatus housing 1 in FIG. 1 are fed therefrom, one sheet by one sheet, by a copy paper feeding roller 22 along a copy paper transport path 20 represented by a two dotted chain line. The copy paper sheet is transported by a set of feed-in transport rollers 25 and 26 through a set of upper and lower guide plates 23 and 24. The copy paper sheet fed into a transfer region 29 through a set of upper and lower guide plates 27 and 28 is further transported in a state where it is closely adhering to the photoreceptor drum 4 confronting the transfer corona charger 8. After the transfer process, the copy paper sheet is separated from the photoreceptor drum 4 by the separating corona charger 9, and is fed into a heat fixing device 33 equipped with a pair of heat fixing rollers 31 and 32 by a copy paper transport device 30. In the heat fixing device 33 as described above, the toner image on the copy paper sheet is fixed onto the copy paper sheet through thermal fusing. After the fixing process, the copy paper sheet is discharged onto a copy paper tray 36 provided at the left in FIG. 1 through a set of discharge rollers 34 and 35.

In the developing device 7 is stored a dual component developing material including toner and carrier particles. In the dual component developing material as described above, the toner is consumed according to the developing processing, and fresh toner is replenished from a toner replenishing device 37 according to the amount of the toner consumption.

Figure 2:
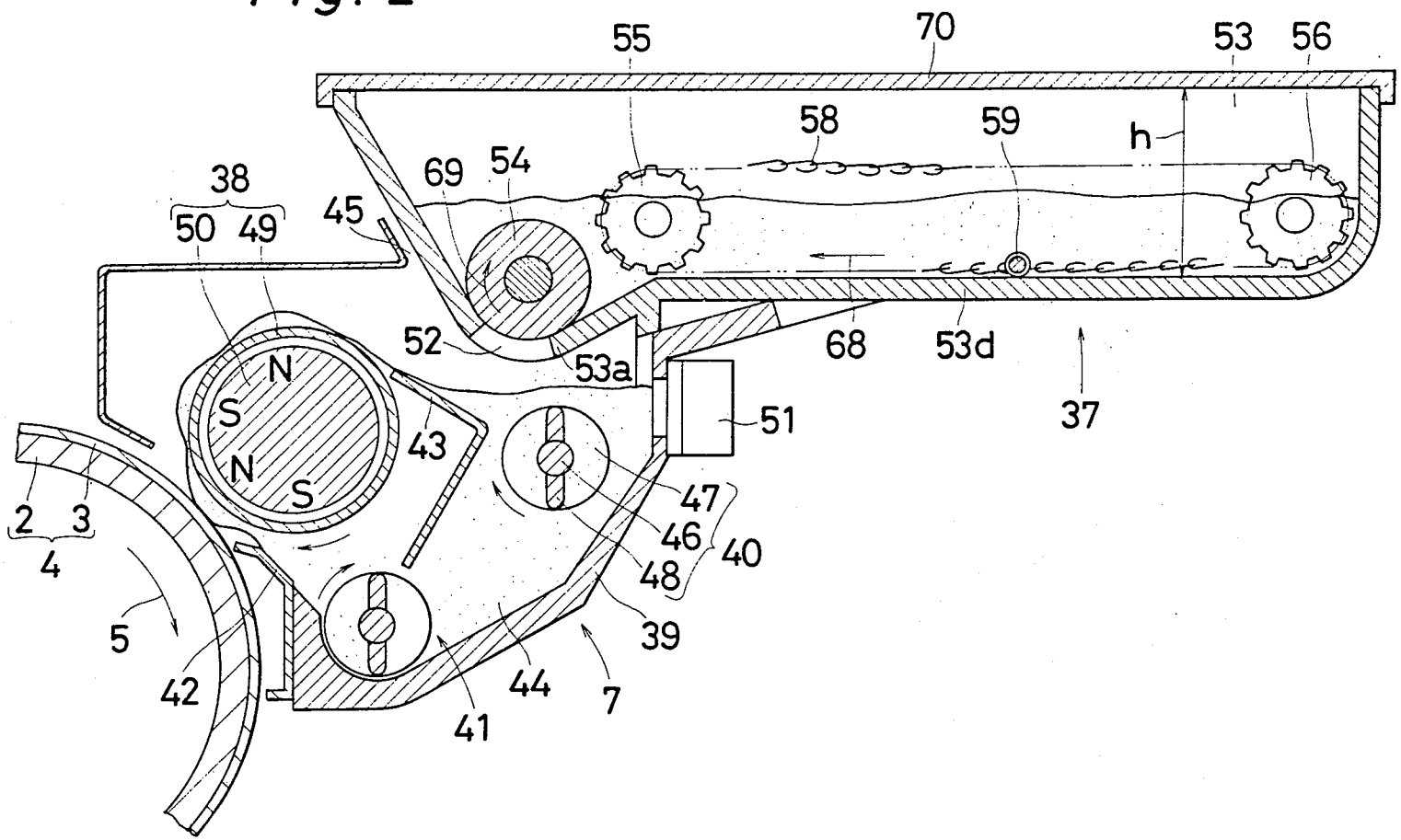
FIG. 2 is a sectional view in the vicinity of a developing device and a toner replenishing device.

Referring particularly to FIG. 2 showing a cross sectional view in the vicinity of the developing device 7 and the toner replenishing device 37 on an enlarged scale, developing device 7 includes a developing roller 38 disposed in a parallel relation with respect to an axis of the photoreceptor drum 4 and in a position close to the photosensitive layer 3 of photoreceptor drum 4, a storage container 39 for storing therein the dual component developing material, a stirring or agitating means 40 for stirring the developing material within storage container 39, a stirring and supplying means 41 for stirring the developing material within storage container 39 and also for supplying the developing material towards the developing roller 38, and a doctor blade 42 for restricting the length of brush bristles of a magnetic brush of developing material to be formed on the outer peripheral surface of the developing roller 38. Within the storage container 39, at a position opposite the photoreceptor drum 4 with respect to the developing roller 38, there is provided a scraping-off plate 43, and between scraping-off plate 43 and the inner wall of the storage container 39 is formed a developing material storing region or portion 44. At the upper part of the developing material storing portion 44 within storage container 39, an opening 45 is formed as shown.

Figure 3:
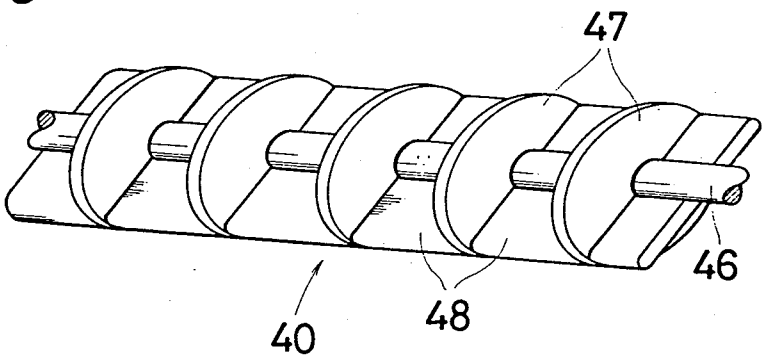
FIG. 3 is a partial perspective view of a stirring means.

The stirring means 40 referred to above is provided at the upper portion of the developing material storing portion 44 in a relation parallel to the developing roller 38, while the stirring and supplying means 41 is disposed at the lower portion of the developing material storing portion 44 in a relation parallel to the stirring means 40. As shown in FIG. 3, the stirring means 40 comprises a rotary rod 46 having its axis directed in parallel to that of the developing roller 38, a plurality of discs 47 fixed to rotary rod 46 in a spaced relation to each other along the axial direction of the rotary rod 46, and directed slantwise with respect to the axis of said rod 46, and corresponding number of flat plates 48 respectively extending radially and outwardly in opposite directions on one diametrical line of the rotary rod 46, between the respective discs 47 as shown. The stirring and supplying means 41 is constructed generally in a manner similar to that of the stirring means 40 as described above. These stirring means 40, and stirring and supplying means 41 are driven for rotation about the axes thereof by a driving force from a driving source, not shown.

The developing roller 38 comprises a hollow developing sleeve 49 of a non-magnetic material, and a permanent magnet 50 concentrically fixed within developing sleeve 49, which is driven for rotation in a direction indicated by a solid line arrow. The developing material supplied onto the outer peripheral surface of the developing roller 38 from the developing material storing portion 44 by the stirring and supplying means 41 is restricted in bristle length by the doctor blade 42 so as to form the magnetic brush, which rubs against the peripheral surface of the photosensitive layer 3 for developing the electrostatic latent image formed on photosensitive layer 3.

To a side wall of the storage container 39 corresponding to the upper portion of the developing material storing portion 44, there is secured a level detector 51 for driving a motor 66 of the toner replenishing device 37 (see FIG. 4 to be described later), through detection of lowering of the upper level for the developing material in the developing material storing portion 44 according to the consumption of the toner. For the level detector 51, a detector which is adapted to detect the level through utilization, for example, of mutual inductance may be employed.

Figure 4:
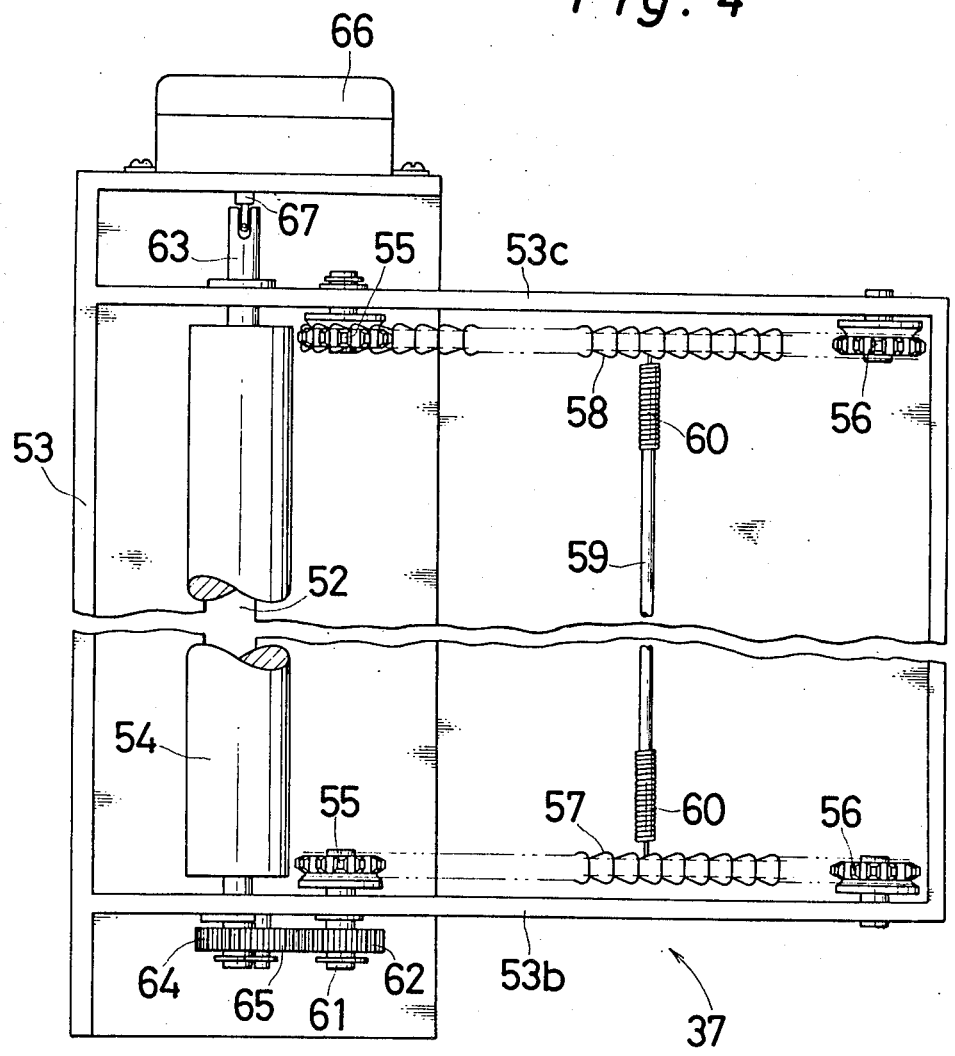
FIG. 4 is a top plan view of the toner replenishing device.

Referring further to FIG. 4, there is shown a top plan view of the toner replenishing device 37. The toner replenishing device 37 includes a storage or supply box 53 extending in a direction at right angles with respect to the axis of the developing roller 38, for example, in a horizontal direction so as to be opened at the upper portion as illustrated, and having a supply port 52 in a bottom portion 53*a* and extending in such horizontal direction (see FIG. 2 also). A supply roller 54 is provided in a position close to the supply port 52 within storing box 53. A first pair of sprockets 55 and a second pair of sprockets 56 respectively are rotatably mounted on opposite side walls 53*b* and 53*c* of the storing box 53 at a position close to supply roller 54 and at another position adjacent to the other end of storing box 53 so as to serve as winding wheels. A pair of chains 57 and 58 are passed around the corresponding sprockets 55 and 56 and serving as endless stretched members. A stirring and supply rod 59 is provided on the chains 57 and 58 so as to extend therebetween and to move therewith along the longitudinal direction of the storing box 53, namely, along a direction generally at right angles to the axis of the developing roller 38.

It should be noted here that the upper portion of the storing box 53 may be arranged to be closed by a cover member 70 which can be selectively raised for opening or lowered for closing, and that the length in the widthwise direction at right angles with respect to the longitudinal direction of the storing box 53 should preferably be selected to correspond to the entire length in the axial direction of the photoreceptor drum 4. Also, the supply port 52 should preferably be formed over the entire length in the axial direction of the photoreceptor drum 4. By the above arrangement, since the toner is uniformly supplied into the developing device 7 over approximately the entire length of the photoreceptor drum 4, undesirable supplying of the toner to a particular position within the developing device 7 can be prevented.

An end portion of the storing box 53 is located above the developing material storing portion 44 within the storage container 39 of the developing device 7 as is seen in FIG. 2. Moreover, the bottom portion 53*a* at a supply end of the storing box 53 is curved so as to be convex downwardly for projecting into the storage container 39 from the opening portion 45. In a position corresponding to the supply port 52 of the storing box 53, the supply roller 54 is rotatably provided to extend between the opposite side walls 53*b* and 53*c*. The supply roller 54 is, for example, a sponge-like roller which is arranged to be in sliding contact with peripheral edges of the supply port 52.

For the pair of chains 57 and 58 as described earlier, for example, ladder chains and the like may be selected. To an end of the stirring and supply rod 59, an end of a coil spring 60 is connected, while the other end of coil spring 60 is engaged with the chain 57 or 58 for supporting the stirring and supply rdd 59. It is to be noted here that the sets of the sprockets 55 and 56 are respectively provided at positions close to the inner faces of the opposite side walls **53*b* and 53*c*, and therefore, the stirring and supply rod 59 and coil spring 60 connected thereto generally extend between the opposite side walls 53*b* and 53*c***.

Figure 5:
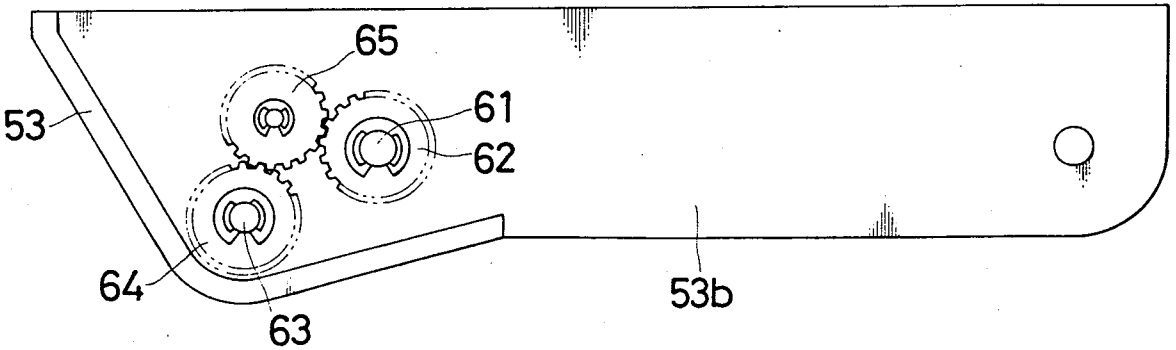
FIG. 5 is a schematic side elevational view of the toner replenishing device.

Reference is further made to FIG. 5 schematically showing a side elevational view of the toner replenishing device 37. A rotary shaft 61 for one of the pair of sprockets 55 is rotatably extended through the side wall **53*b*, while a gear 62 is fixedly mounted on the outer end of shaft 61. A rotary shaft 63 of the supply roller 54 rotatably extends, at its opposite ends, through the side walls 53*b* and 53*c*, with a gear 64 being secured to are end of the shaft 63 as shown. The gear 64 is engaged with the gear 62, through a gear 65 rotatably mounted on the side wall 53*b*. In an outer position corresponding to the side wall 53*c* of the storing box 53, there is provided the motor 66, while the output shaft 67 of the motor 66 is connected to the other end of the rotary shaft 63**.

The motor 66 is arranged to be driven when the level of the developing material in the developing material storing portion 44 is detected to be lower than a predetermined level by the level detector 51. By the driving force of motor 66, the supply roller 54 is driven for rotation in the direction of an arrow 69, while the chains 57 and 58 are caused to run in the direction of an arrow 68 through the gears 64, 65 and 62.

In the toner replenishing device 37 as described above, the chains 57 and 58 are driven to move by the driving force of the motor 66, and upon movement of chains 57 and 58, the stirring and supply rod 59 is moved in the direction indicated by the arrow 68. Therefore, the toner stored in the storing box 53 is moved towards the supply roller 54 by the stirring and supply rod 59 in a portion close to the bottom portion **53*d* of the storing box 53. Meanwhile, at the upper part in the storing box 53, the toner is moved in a direction to be spaced from the supply roller 54 by the stirring and supply rod 59. Consequently, toner is sufficiently agitated within the storing box 53, with the peripheral surface of the supply roller 54** being in contact with the toner at all times.

Accordingly, even when a depth h (FIG. 2) of the storing box 53 is small, the toner within the storing box 53 is fully stirred, while, since the toner is always in the vicinity of the peripheral surface of the supply roller 54, a stable supply of the toner may be achieved until it is almost completely used up.

It should be noted here that, for another embodiment of the present invention, the sprockets 55 and 56 and the chains 57 and 58 described as employed in the foregoing embodiment may be replaced, for example, by pulleys, and wires or belts, and that, although the present invention has been described with reference to a dual component developing material, the replenishing device of the present invention is not limited in application to the dual component developing material alone, but may readily be used as a replenishing device for replenishing a monocomponent developing material as well.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. In a developing device for developing a visible toner image from an electrostatic latent image on a photosensitive surface in an electrostatic copying apparatus, said developing device being of the type including a storage container mounting therein a developing roller and to be positioned with said developing roller positioned adjacent the photosensitive surface, stirring means for agitating toner within said storage container and supplying the toner to said developing roller, and means for replenishing the supply of toner to said storage container, the improvement wherein said replenishing means comprises:

an elongated opening in an upper portion of said storage container at a position generally above said stirring means;

a toner supply box having a supply end with a convexly downwardly curved bottom portion, an elongated supply port formed in said bottom portion, a bottom wall extending from said bottom portion, and a pair of parallel side walls spaced by said bottom portion and said bottom wall;

a supply roller rotatably mounted between said side walls in said bottom portion adjacent said supply port;

said supply box being mounted above said storage container with said bottom portion of said supply box extending downwardly through said elongated opening in said upper portion of said storage container, with said bottom wall of said supply box extending horizontally away from said developing roller, and with the axis of said supply roller being parallel to the axis of said developing roller;

a first pair of sprockets mounted on respective said side walls at positions adjacent said supply roller to have a common horizontal axis parallel to said axis of said supply roller;

a second pair of sprockets mounted on respective said side walls at positions spaced from said supply roller to have a common horizontal axis parallel to said axis of said supply roller;

a pair of chains passing around respective said sprockets of said first and second pairs thereof at positions adjacent respective said side walls, such that said chains have respective lower runs and upper runs;

a stirring and supply rod fixed between said chains and having an axis parallel to said axis of said supply roller;

gear transmission means between said supply roller and one of said first pair of sprockets; and means for rotating said supply roller in a direction of rotation such that said gear transmission means and said sprockets cause movement of said chains such that said lower runs move adjacent said bottom wall of said supply box toward said supply roller, whereby toner in said supply box is moved by said rod along said bottom wall to said supply roller and then is moved by said supply roller through said supply port and into said storage container, and such that said upper runs of said chains move away from said supply roller, whereby toner at an upper portion of said supply box is agitated by said rod moving away from said supply roller.

2. The improvement claimed in claim 1, wherein said gear transmission means comprises a first gear fixed to said supply roller, a second gear fixed to said one sprocket, and a third gear meshing with said first and second gears.

* * * * *